US005127130A

United States Patent [19]

Copito

[11] Patent Number: 5,127,130

[45] Date of Patent: Jul. 7, 1992

[54] WRITING END ERASER FOR A DOUBLE ACTING MECHANICAL PENCIL OR ERASABLE INK BALL POINT PEN

[76] Inventor: Benjamin Copito, 20 Clent Road, Great Neck, N.Y. 11021

[21] Appl. No.: 748,759

[22] Filed: Aug. 22, 1991

[51] Int. Cl.[5] ..... B43K 29/02

[52] U.S. Cl. ..... 15/428; 15/431

[58] Field of Search ..... 15/424, 428, 429, 430, 15/431

[56] References Cited

U.S. PATENT DOCUMENTS

| | | | |
|---|---|---|---|
| 1,473,090 | 11/1923 | Ferry | 15/428 |
| 1,580,183 | 4/1926 | Veillette | 15/428 |
| 1,671,393 | 5/1928 | Zantow | 15/429 |
| 2,069,462 | 2/1937 | Rouse | 15/428 |
| 2,815,002 | 12/1957 | Mayes | 15/428 |
| 3,072,101 | 1/1963 | Kovacs | 15/429 X |
| 3,099,251 | 7/1963 | Hertz | 15/429 |
| 4,352,580 | 10/1983 | Ando | 15/429 X |
| 4,899,419 | 2/1990 | Saleen | 15/428 |

FOREIGN PATENT DOCUMENTS

| | | | |
|---|---|---|---|
| 483313 | 11/1951 | Italy | 15/428 |

*Primary Examiner*—Chris K. Moore

[57] ABSTRACT

A pencil eraser or erasable ink ball point pen eraser in the shape and form of a cowling sleeve affixed to the front end of either a double acting mechanical pencil or single acting ball point pen, wherein the writing elements of the pencil or pen may be withdrawn through spring action, making the eraser available for almost immediate application at the writing end of either instrument to erase whatever writing is to be erased, obviating the need for reversal of the ends of either writing instrument for access to an eraser at the non-writing end of these instruments.

7 Claims, 4 Drawing Sheets (EXPANDED SECTION)

WRITING END ERASER FOR A DOUBLE ACTING MECHANICAL PENCIL OR ERASABLE INK BALL POINT PEN

BACKGROUND

1. Field of Invention

This invention relates to a pencil eraser of rubber or plastic material serving as the writing end statically affixed cowling sleeve of a double acting mechanical pencil, through which extends and retracts the frustum shaped segment and lead sleeve of the mechanical pencil, and to a ball point pen eraser of rubber or plastic material serving as the writing end statically-affixed cowling sleeve of a single acting ball point pen utilizing erasable ink, through which the ball point and ink feeding tube extends and retracts.

2l. Description of Prior Art

Both mechanical and conventional wood pencils have, for many years, been adapted to provide an attached eraser at the end of the cylindrical pencil barrel opposite that from which the pencil lead extends. Conventional wood pencils typically are provided with a non-renewable and non-adjustable eraser attached by means of a cylindrical band and sized such that the exhaustion of the usable portion of the eraser will coincide with the life of the pencil as it is used and resharpened.

Mechanical pencils, on the other hand, have a virtually unlimited life by virtue of replacement pencil leads. As a result, mechanical pencils are sometimes provided with some sort of adjustable eraser mechanism and replacement erasers at the non-writing ends of the pencils. Examples of these eraser adjustment mechanisms can be found in U.S. Pat. Nos. 1,671,393; 3,072,101; 3,099,251; and 4,352,580. Each of the above listed U.S. Patents provides a unique type of adjustment mechanism to facilitate extension of additional portions of an eraser at the non-writing end as it is consumed in normal use.

U.S. Pat. No. 1,473,090 to Ferry (1923) discloses a circular sleeved eraser assembly mounted on the outside of a plain lead pencil, through which the writing end of the pencil protrudes, and which places the eraser in close proximity to the lead point. A sliding of the assembly forward places the eraser segment at and beyond the lead point of the pencil for erasure of written material.

This eraser assembly suffers several disadvantages: the assembly at the writing end unbalances the pencil, obscures the point of the pencil and the written material, is subject to relatively easy loss or mislocation, and is a meaningful obstruction to placement in a pocket.

U.S. Pat. No. 4,899,419 to Saleen (1990) discloses a circular, sleeved eraser eraser assembly similar in intent to that of U.S. Pat. No. 1,473,090 to Ferry (1923), but for use with a mechanical pencil, and suffers the same several disadvantages noted above.

None of the above listed attempts to provide maximum convenience to the user of a conventional or mechanical pencil eraser has succeeded in making the application of the eraser almost as easy or convenient as the application of the lead point.

It is the object of this invention to do just that, and to do so with a device which is inexpensive and simple to manufacture

Objects and Advantages

Accordingly, several objects and advantages of my invention are:

1. The statically-affixed cowling sleeve at the writing end, through which the frustum shaped segment and lead sleeve extend and retract, is itself an eraser of rubber or plastic material, and is almost instantly available at the point of writing by virtue of spring-actuated withdrawal of the frustum-shaped segment and lead sleeve to erase what has been written by the lead point of the double acting mechanical pencil.
2. In addition to serving as statically-affixed cowling sleeve and protective end of the mechanical pencil, the cowling sleeve represents an actual architecturally and mechanically performing part of the mechanical pencil, thereby achieving a unique degree of economic efficiency.
3. The statically-affixed cowling sleeve eraser is screwed into the body of the cylindrical barrel, and may be utilized as long as the user finds the diminished length and need to flatten the angle of the mechanical pencil in an erasing mode acceptable. Thereafter, the user need simply screw out the consumed cowling sleeve eraser, while carefully retaining the spring, and screw in a replacement cowling sleeve eraser.
4. The placement of the eraser in the form of a front cowling sleeve of the double acting mechanical pencil obviates the need for any eraser at the opposite end, and completely eliminates the need for complex and expensive eraser adjustment mechanisms such as those embodied in U.S. Pat. Nos. 1,671,393; 3,072,101; 3,099,251; or 4,352,580 mentioned previously.
5. The rubber or plastic material statically-affixed cowling sleeve eraser also serves as a protective shield against physical injury or damage to articles of clothing.
6. The comments of 1 through 5 above apply equally to a conventional, single acting ball point pen utilizing erasable ink. The statically-affixed cowling sleeve eraser for utilization with erasable ink will possibly require a different composition of rubber or plastic material.

Further objects and advantages of my invention will become apparent from a consideration of the drawings and ensuing description of it.

DRAWING FIGURES

Figure 8:
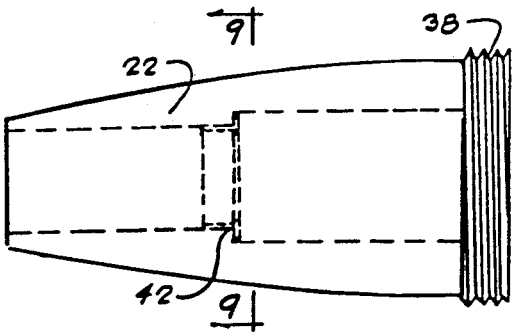

FIG. 8 shows a full length view of the statically-affixed cowling sleeve eraser of the second embodiment of my invention, indicating a male threaded metal cincture opposite the writing end and the two different bore diameters through the center of the cowling sleeve eraser. A short, shouldered sleeve is indicated set in upon the shoulder of the smaller diameter bore where it joins the larger diameter bore.

Figure 9:
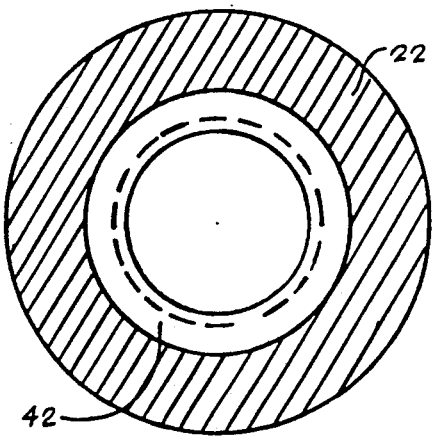

FIG. 9 shows a cross section through the statically-affixed cowling sleeve eraser fo the second embodiment of my invention indicating the shouldered sleeve set in upon the shoulder of the smaller diameter bore.

Figure 1:
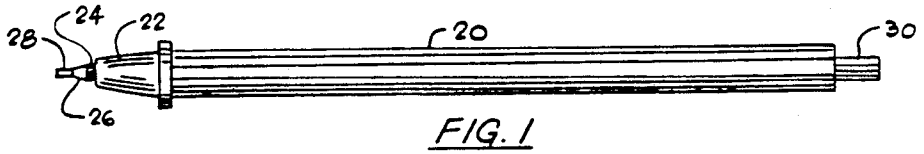
FIG. 1 shows a full length elevation of a double acting mechanical pencil with statically-affixed cowling sleeve eraser at the writing end, through which extends the frustum shaped segment and lead sleeve.
Figure 10:
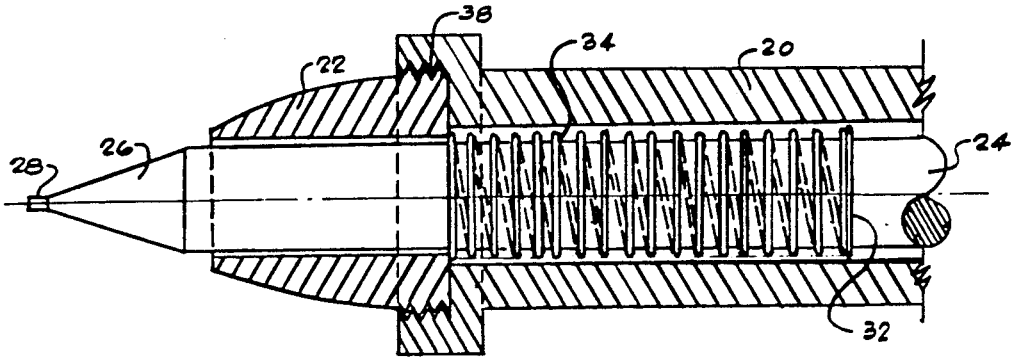

FIG. 10 shows a longitudinal cross section of a third embodiment of my invention, portraying the forward end of the same double acting mechanical pencil of FIG. 1 in a writing position.

Figure 11:
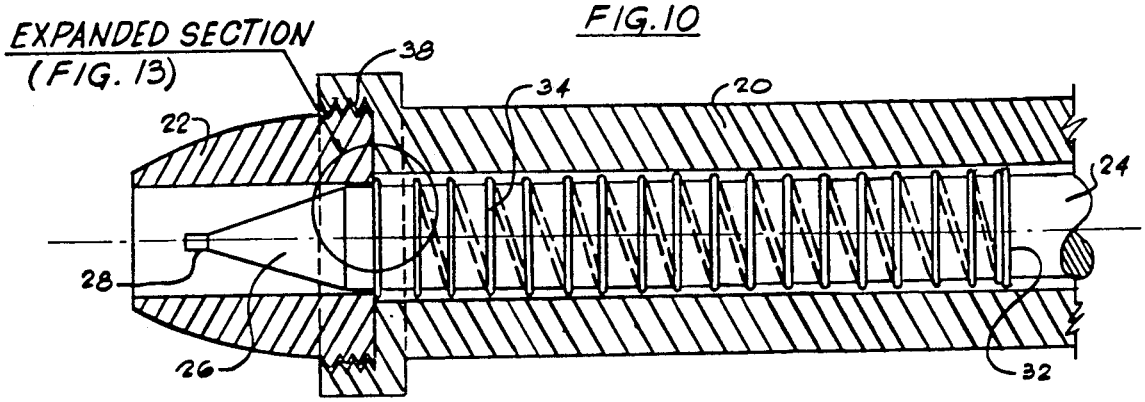

FIG. 11 shows a longitudinal cross section of a third embodiment of my invention, portraying the forward end of the same double acting mechanical pencil of FIG. 1 in a retracted position, with the statically affixed cowling sleeve eraser free to perform as an eraser at the writing end.

Figure 12:
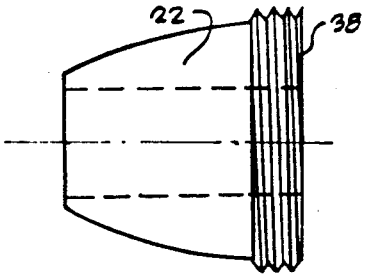

FIG. 12 shows a full length view of the third embodiment of my invention, portraying the statically-affixed cowling sleeve eraser and indicating a male threaded cincture opposite the writing end.

Figure 13:
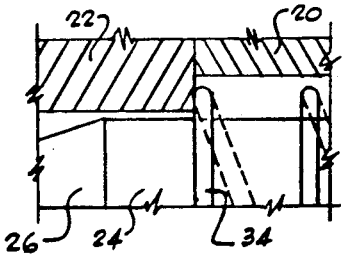

FIG. 13 shows an expanded section of a part of FIG. 11, which portrays the third embodiment of my invention, and indicates the withdrawal spring activator resting upon the shoulder of the bore through the statically-affixed cowling sleeve eraser.

Figure 14:
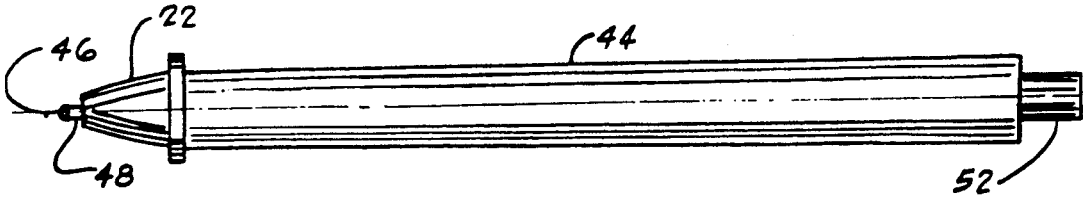

FIG. 14 shows a full length elevation of a single acting ball point pen utilizing erasable ink, with a statically-affixed cowling sleeve eraser at the writing end, through which extends the ball point and a part of the ink feeding tube, which portrays the fourth embodiment of my invention.

Figure 15:
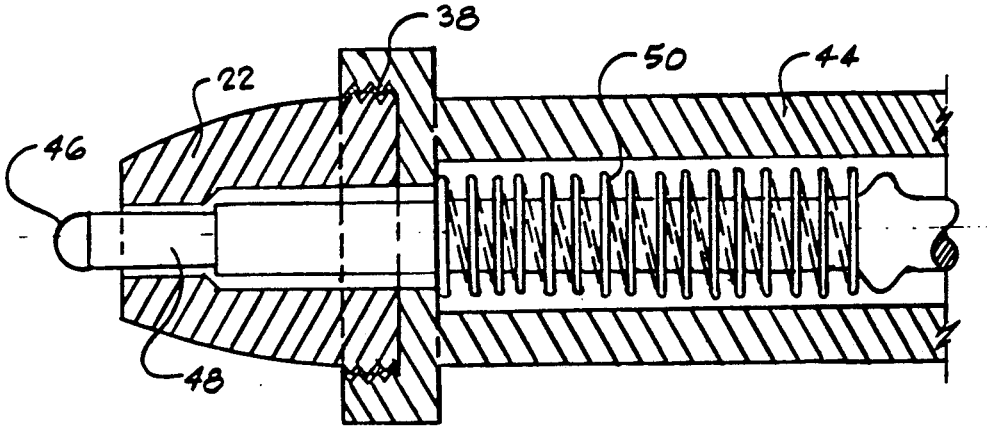

FIG. 15 shows a longitudinal cross section of the forward end of FIG. 14 in an extended position, through statically-affixed cowling sleeve eraser, with the ball point and ink feeding tube in a writing position.

Figure 16:
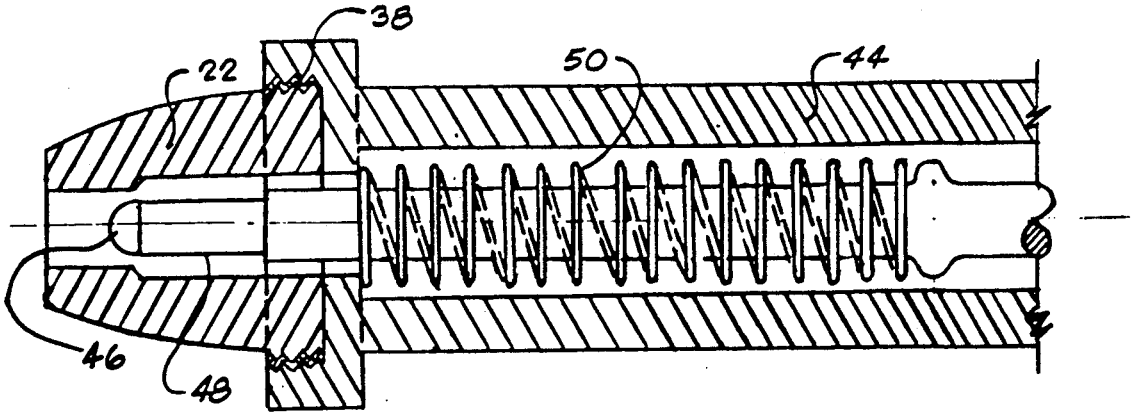

FIG. 16 shows a longitudinal cross section of the forward end of FIG. 14 in a retracted position within the statically-affixed cowling sleeve eraser, with the statically-affixed cowling sleeve eraser free to perform as an eraser at the writing end.

REFERENCE NUMERALS IN DRAWINGS 20 double acting mechanical pencil barrel
22 statically-affixed cowling sleeve eraser or rubber or plastic material
24 leads advancing and storage mechanism
26 frustum shaped segment
28 lead sleeve
30 double acting actuator
32 spring stop on perimeter of lead advancing and storage mechanism
34 spring for retraction of lead advancing and storing mechanism, frustum shaped segment, and lead sleeve
36 metal washer
38 male threaded metal cowling sleeve eraser cincture
40 prong of metal washer
42 shouldered sleeve
44 retractable ball point pen barrel
46 ball point
48 ink feeding tube
50 retraction spring
52 ball point pen actuator

DESCRIPTION— FIGS. 1 to 16

FIG. 1 shows a full length elevation of a double acting mechanical pencil with lead sleeve 28, frustum shaped segment 26, leading advancing and storage mechanism 24, cowling sleeve eraser of rubber or plastic material 22, double acting mechanical pencil barrel 20, and double acting actuator 30. The pencil is shown in a writing mode.

Figure 2:
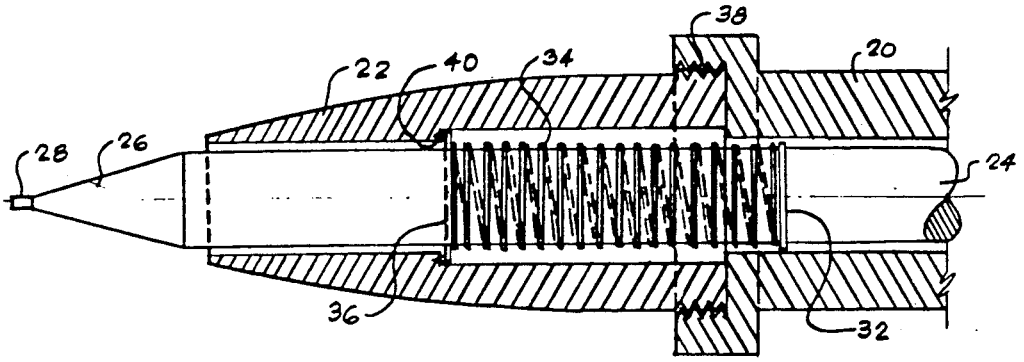
FIG. 2 shows a longitudinal cross section of the forward end of the double acting mechanical pencil of the forward end of the double acting mechanical pencil of FIG. 1 in an extended position, with the frustum shaped segment and lead sleeve projecting beyond the statically-affixed cowling sleeve eraser in a writing position.

FIG. 2 shows a cross section of the front end of the double acting mechanical pencil of FIG. 1 in detail, and in the same writing mode as in FIG. 1. The lead sleeve 28 and the frustum shaped segment 26, as well as a part of the lead advancing and storage mechanism 24, are shown extended through the cowling sleeve eraser 22. Also shown are the spring 34 for retraction of the lead advancing and storage mechanism 24, frustum shaped segment 26, and lead sleeve 28. The spring 34 is shown in a compressed state between a metal washer 36 and is shown in a compressed state between a metal washer 36 and a spring stop 32 on the perimeter of the lead advancing and storage mechanism 24. The condition shown is accomplished by a full compression of the double acting actuator 30. Thereafter, short compressions of the double acting actuator 30 advance the lead through the lead sleeve 28.

The metal washer 36 is shown pronged 40 into the shoulder of the cowling sleeve eraser 22 where the narrow and wider bores meet.

The cowling sleeve eraser of rubber or plastic material 22 is shown screwed into the mechanical pencil barrel 20, utilizing a male threaded cincture 38 affixed to the wider end of the cowling sleeve eraser 22.

Figure 3:
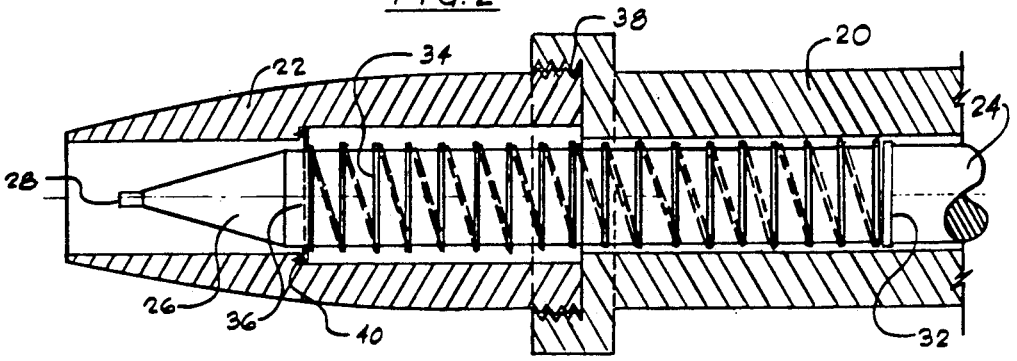
FIG. 3 shows a longitudinal cross section of the forward end of the double acting mechanical pencil of FIG. 1 in a retracted position, with the statically-affixed cowling sleeve eraser free to perform as an eraser at the writing end.

FIG. 3. shows a cross section of the front end of the double acting mechanical pencil of FIG. 1 in detail, but in a retracted mode, achieved by another full compression of the double acting acting actuator 30. All components are as described for FIG. 2.

Figure 4:
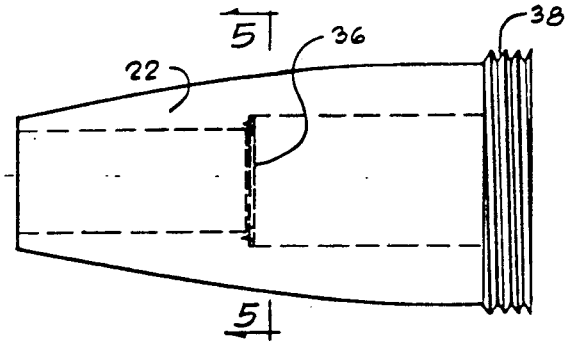
FIG. 4 shows a full length view of the statically-affixed cowling sleeve eraser, indicating a male threaded cincture opposite the writing end and the two different bore diameters through the center of the cowling sleeve eraser. A pronged washer is indicated set in upon the houlder of the smaller diameter bore where it joins the larger diameter bore.

FIG. 4 shows an elevation of the cowling sleeve eraser of rubber or plastic material 22, indicating the seated washer 36 and the metal cincture 38.

Figure 5:
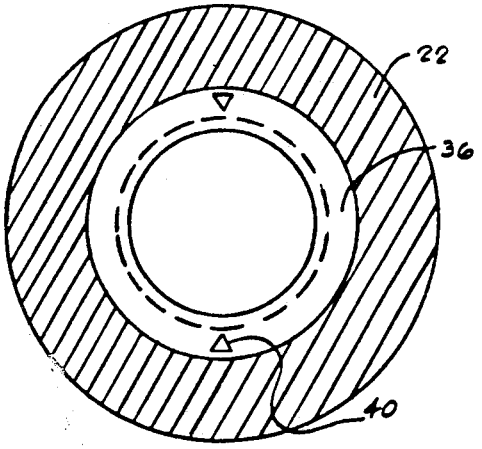
FIG. 5 shows a cross section through the statically-affixed eraser indicating the washer seated upon the shoulder created at the juncture of the smaller and larger diameter bores.

FIG. 5 shows a cross section through the cowling sleeve eraser 22 of FIG. 4 indicating the metal washer 36 and two prongs 40.

Figure 6:
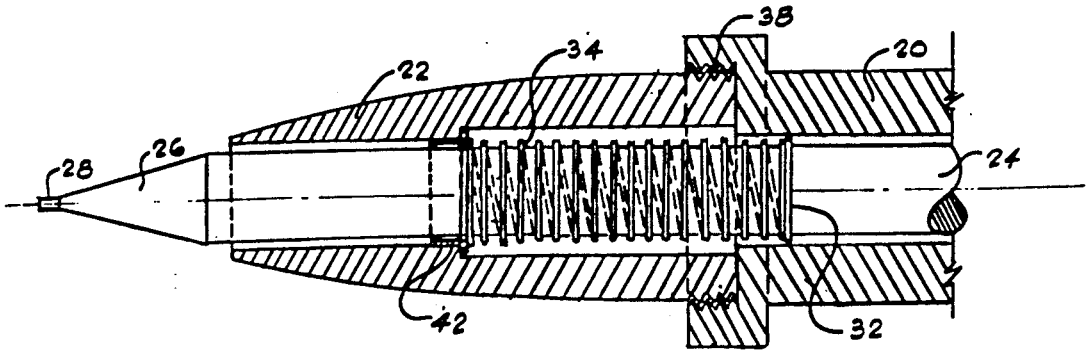
FIG. 6 shows a longitudinal cross section of a second embodiment of my invention, portraying the forward end of the same double acting mechanical pencil of FIG. 1 in a writing position.

FIG. 6 shows a cross section of a second embodiment of the double acting mechanical pencil of FIG. 1 in a writing mode. All components, save one, are the same as shown on FIGS. 2 and 3. In this embodiment, the spring 34 rests, in a forward direction, not upon a washer, but upon a short, shoulder sleeve set in upon the shoulder of the smaller diameter bore where it joins the larger diameter bore.

Figure 7:
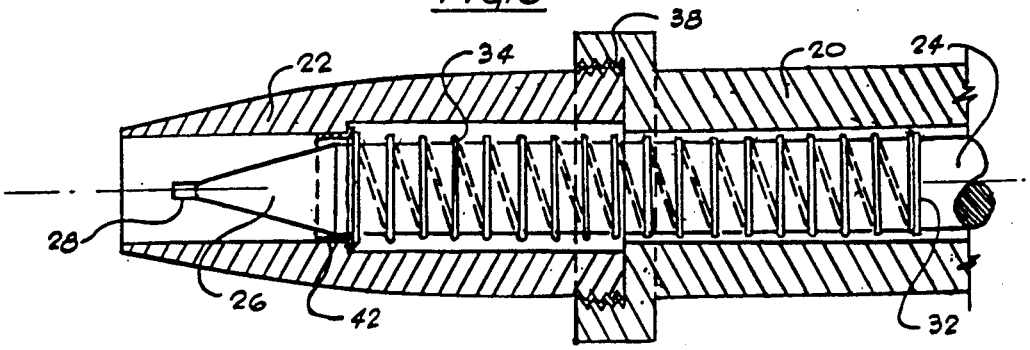
FIG. 7 shows a longitudinal cross section of a second embodiment of my invention, portraying the forward end of the same double actign mechanical pencil of FIG. 1 in a retracted position, with the statically-affixed cowling sleeve eraser free to perform as an eraser at the writing end.

FIG. 7 shows a cross section of the second embodiment described above for FIG. 6, in a retracted mode. All components are the same as described for FIG. 6.

FIG. 8 shos an elevation of the cowling sleeve eraser 22 of FIGS. 6 and 7, and indicates the short, shouldered sleeve 42 and the metal cincture 38.

FIG. 9 shows a cross section through the cowling sleeve eraser 22 of FIG. 8, indicating the short, shouldered sleeve 42 seated on the smaller of two bore diameters.

FIG. 10 shows a cross section of a third embodiment of the double acting mechanical pencil of FIG. 1 in a writing mode. In this embodiment, the spring 34 rests, in a forward direction, neither upon a washer nor a short, shouldered sleeve, but upon the rear surface of the cowling sleeve eraser 22.

FIG. 11 shows a cross section of the third embodiment described above for FIG. 10, in a retracted mode. All components are the same as described for FIG. 10.

FIG. 12 shows an elevation of the cowling sleeve eraser 22 of FIGS. 10 and 11 and the metal cincture 38.

FIG. 13 shows an expaned section of a part of FIG. 11, indicating cowling sleeve eraser 22, pencil barrel 20, frustum shaped segment 26, lead advancing and storage mechanism 24, and the spring 34 of the third embodiment resting upon the rear surface of the cowling sleeve eraser 22.

FIG. 14 shows a full length elevation of a single acting ball point pen utilizing erasable ink, with a cowling sleeve eraser 22 at the writing end, the ball of the ball point pen 46, the ink feeding tube 48, the pen barrel 44, and the ball point pen actuator 52.

FIG. 15 shows a cross section of the fourth embodiment of my invention, portraying the front end of the single acting ball point pen of FIG. 14, in the writing mode of FIG. 14, and indicating the cowling sleeve eraser 22, the ball point 46, the ink feeding tube 48, the metal cincture 38, the retractable ball point pen barrel 44, and the retraction spring 50.

FIG. 16 shows a cross section of the fourth embodiment of my invention, described above for FIG. 15, in a retracted mode. All components are the same as described for FIG. 15.

OPERATION—FIGS. 1 TO 6

My invention is designed to provide a practical, effective, and simple erasing mechanism at the writing end of a double acting mechanical pencil or single acting ball point pen utilizing erasable ink. The use of a statically-affixed cowling sleeve eraser in conjunction with a double acting mechanical pencil or single acting ball point pen utilizing erasable ink, wherein the actual writing mechanisms may readily be withdrawn by spring-release action into the bodies of the writing instruments, represents a solution long sought for in a hand held writing instrument. Such solution is analagous to the present day correctable tape solution of the modern typewriter.

In the first embodiment of FIGS. 2 and 3, the spring 34 for retraction of the lead advancing and storage mechanism 24, frustum shaped segment 26, and lead sleeve 28, is shown to rest, at the forward end, upon a metal washer 36 seated upon and pronged 40 into the cowling sleeve eraser 22 shoulder of a narrowed bore.

The extension of the spring 34 into the body of the cowling sleeve eraser 22 permits a longer body for same without increasing the overall length of the double acting mechanical pencil of FIG. 1. It also permits a tradeoff between cowling sleeve eraser availability for erasing and any necessary pencil length increase.

The first full pressing of the double acting actuator 30, from the retracted position shown in FIG. 3, extends the lead advancing and storage mechanism 24, frustum shaped segment 26, and lead sleeve 28 to the position shown in FIG. 2. A series of subsequent lighter pressings of the double acting actuator 30 advances the lead through the lead sleeve 28 for writing. To erase what has been written, another full pressing of the actuator 30 is made, withdrawing by spring-release action the lead advancing and storage mechanism 24, frustum shaped segment 26, and lead sleeve 28 within the cowling seeve eraser 22, permitting the unobstructed use of the cowling sleeve eraser 22.

In the second embodiment of FIGS. 6 and 7, the operation of the double acting mechanical pencil of FIG. 1 is identical to that of the first embodiment; the difference being only in the placement of the spring 34 for retraction of the lead advancing and storage mechanism 24, frustum shaped segment 26, and lead sleeve 28, upon the short, shouldered sleeve 42 inserted in the smaller of the two bores within the cowling sleeve eraser 22. This embodiment provides for the reinforcement of the shoulder formed at the intersection of the two bores within the cowling sleeve eraser 22.

In the third embodiment of FIGS. 10 and 11, the operation of the double acting mechanical pencil of FIG. 1 is identical to that of the first and second embodiments; the difference being only in the placement of the spring 34 for retraction of the lead advancing and storage mechanism 24, frustum shaped segment 26, and lead sleeve 28, upon the shoulder of the coweling sleeve eraser 22 itself at its interior terminus within the double acting mechanical pencil barrel 20. This embodiment can save the cost of a double bore and a metal washer or short, shouldered sleeve in the cowling sleeve eraser 22, should the rubber or plastic material of the cowling sleeve eraser 22 readily bear the stress of the spring 34.

The fourth embodiment of my invention is portrayed in FIGS. 14, 15, and 16, where a single acting ball point pen utilizing erasable ink is shown with a cowling sleeve eraser 22 at its writing end, through which the ball 46 and the ink feeding tube 48 extend and retract through the cowling sleeve eraser 22.

FIG. 15 shows the ball 46 and the ink feeding tube 48 in an extended position for writing in a cross section of the forward end of the single acting ball point pen.

FIG. 16 shows the ball 46 and the ink feeding tube 48 in a retracted position within the cowling sleeve eraser 22 in this cross section of the forward end of the single acting ball point pen, and therefore making the cowling sleeve eraser 22 available to function as a writing end eraser.

SUMMARY, RAMIFICATIONS, AND SCOPE

Thus the reader can see that the writing end eraser of this invention, performing the function of an eraser, as well an architectural and mechanical feature of the writing instruments, represents a simple, clean, and elegant solution to the problem of reversal of the ends of a pencil or ball point pen utilizing erasable ink to write and then erase.

While my above descriptions contain many specificities, these should not be construed as limitations on the scope of the invention, but rather as the exemplification of the four embodiments shown.

The embodiments shown and described above and in the drawings are not limited in application to mechanical pencils and ball point pens utilizing erasable ink actuated from the end opposite the writing end, but are equally applicable where actuation is made from side positions on the barrels of such mechanical pencils and single acting ball point pens. Nor are the embodiments shown and described above limited in application to retractable ball point pens utilizing erasable ink; but are equally applicable to retractable pens utilizing erasable ink which utilize other types of points, such as fiber, felt, or other synthetic, non-metallic, ink conveying writing tips.

Accordingly, the scope of the invention should be determined, not by the embodiments illustrated or described, but by the attendant claims and their legal equivalents.

It is to be noted that, whereas reference is made herein to specific elements of a double acting mechanical pencil and a single acting ball point pen, these elements are not germane to this invention, which has been designed to be accomodative and not restrictive of a variety of designs of these writing instruments.

I claim:

1. A pencil eraser in the shape and form of a tapered cowling sleeve, affixed concentrically and statically onto the front end of the barrel of a double-acting mechanical pencil, and constituting the front end of said double-acting mechanical pencil when in a retracted state; said statically-affixed tapered cowling sleeve eraser being provided with internal concentric bore means for resisting the compression of a spring for spring-activated withdrawal and extension of the mechanical writing elements of said double-acting mechanical pencil through said tapered cowling sleeve while also providing support for and passage of said mechanical writing elements, thereby providing virtually instant availability for writing-end erasure of written material.

2. The front-end, statically-affixed, tapered cowling sleeve eraser of claim 1; wherein the spring for retraction of the mechanical writing elements, at its forward end, rests upon a washer bearing upon the shoulder of a tapered cowling sleeve eraser bore.

3. The front-end, statically-affixed, tapered cowling sleeve eraser of claim 1; wherein the spring for retraction of the mechanical writing elements, at its forward end, rests upon a short, shouldered sleeve placed within a tapered cowling sleeve eraser bore, being set upon the shoulder of said tapered cowling sleeve eraser bore.

4. The front-end, statically-affixed, tapered cowling sleeve eraser of claim 1; wherein the spring for retraction of the mechanical writing elements, at its forward end, rests upon the rear surface of said tapered cowling sleeve eraser.

5. The front-end, statically-affixed, tapered cowling sleeve eraser of claim 1; wherein said tapered cowling sleeve eraser represents a functioning, combined architectural and mechanical element of a double-acting mechanical pencil.

6. An eraser of suitable rubber or plastic material in the shape and form of the tapered cowling sleeve of a retractable pen utilizing erasable ink, statically affixed concentrically onto the front end of the barrel of said retractable pen, and constituting the front end of said retractable pen when the point and erasable ink feeding tube are withdrawn within said tapered cowling sleeve; whereby said eraser, upon retraction of said point and said ink feeding tube of erasable ink, is almost instantly available for writing-end erasure of written material.

7. The front-end statically-affixed, tapered cowling sleeve eraser of claim 6; wherein said front-end, statically-affixed, tapered cowling sleeve eraser represents a fixed, although replaceable, architectural element of the retractable pen utilizing erasable ink.

* * * * *

UNITED STATES PATENT AND TRADEMARK OFFICE

CERTIFICATE OF CORRECTION

PATENT NO. : 5,127,130
DATED : July 7, 1992
INVENTOR(S) : Benjamin Copito

It is certified that error appears in the above-indentified patent and that said Letters Patent is hereby corrected as shown below:

Page 1, line 57, delete the second term "eraser"

Page 3, line 4, delete "houlder" and replace with --shoulder--
Page 3, line 16, delete "actign" and replace with --acting--
Page 3, line 29, delete "fo" and replace with --of--
Page 3, line 59, after "through" insert --the--
Page 4, line 1, delete "or" and replace with --of--
Page 4, line 3, delete "leads" and replace with --lead--
Page 4, line 24, delete "leading" and insert --lead--
Page 4, lines 38 & 39, delete redundant sentence fragment "and is shown in a compressed state between a metal washer 36"
Page 4, line 56, delete the redundant term "acting"
Page 5, line 49, delete "6" and replace with --16--

Page 6, line 17, delete "seeve" and insert --sleeve--

Signed and Sealed this

Twenty-first Day of September, 1993

Bruce Lehman

*Attest:*

BRUCE LEHMAN

*Attesting Officer*

*Commissioner of Patents and Trademarks*